US011812879B2

(12) United States Patent
Born et al.

(10) Patent No.: US 11,812,879 B2
(45) Date of Patent: Nov. 14, 2023

(54) MODULAR PORTABLE BEDDING SYSTEM

(71) Applicant: Born Outdoor Group Ltd, Lafayette, CO (US)

(72) Inventors: Stuart K Born, Lafayette, CO (US); Roy Swanson, Sedalia, CO (US); Nate Durant, Denver, CO (US); Tom Kvilhaug, Edwards, CO (US)

(73) Assignee: Born Outdoor Group, Ltd., Lafayette, CO (US)

( * ) Notice: Subject to any disclaimer, the term of this patent is extended or adjusted under 35 U.S.C. 154(b) by 0 days.

(21) Appl. No.: 17/683,209

(22) Filed: Feb. 28, 2022

(65) Prior Publication Data

US 2022/0273120 A1 Sep. 1, 2022

Related U.S. Application Data

(60) Provisional application No. 63/200,297, filed on Feb. 28, 2021.

(51) Int. Cl.
*A47G 9/08* (2006.01)

(52) U.S. Cl.
CPC ..... *A47G 9/086* (2013.01); *A47G 9/08* (2013.01)

(58) Field of Classification Search
CPC ..... A47G 9/086; A47G 9/083; A47G 9/08; Y10T 24/2502; Y10T 24/2509; Y10T 24/2561
USPC ..... 5/413 R; 2/69.5; 24/381, 382, 386
See application file for complete search history.

(56) References Cited

U.S. PATENT DOCUMENTS 2,064,458 A * 12/1936 Bulpit et al. ..... A47G 9/0207 5/413 R
2,151,462 A * 3/1939 Bulpit et al. ..... A47G 9/086 5/413 R
2,789,292 A * 4/1957 Budinquest ..... A47G 9/02 5/494

(Continued)

FOREIGN PATENT DOCUMENTS

CA 2857040 C 12/2016
CN 202386348 U 8/2012

(Continued)

OTHER PUBLICATIONS

Sierra Trails, "DIY: Adventure Pup Sleeping Bag", Aug. 6, 2015, https://trailspress.com/2015/08/06/diy-adventure-pup-sleeping-bag/.

(Continued)

*Primary Examiner* — Robert G Santos
(74) *Attorney, Agent, or Firm* — LeFevour Law, LLC; Martin T. LeFevour

(57) ABSTRACT

A modular portable bedding system that emulates the home sleeping experience as much as possible, where users can easily remove or change different components to customize the system to optimize the sleeping experience for the environment they plan on using it in, while still allowing the user to easily transport the customized bedding system. The bedding system of the present invention may include four main components: a base shell, a sleeping pad, a sheet layer and an insulation layer, and in a more specific configuration, the bedding system of the present invention may have the base shell, the sleeping pad, a fitted sheet and a standard sheet in the sheet layer, a down quilt and synthetic quilt in the insulation layer and a top layer.

20 Claims, 22 Drawing Sheets

(56) References Cited

U.S. PATENT DOCUMENTS

| | | | | |
|---|---|---|---|---|
| 2,972,757 | A * | 2/1961 | Adrian | A47G 9/086 5/413 R |
| 3,175,231 | A | 3/1965 | Magario et al. | |
| 3,317,933 | A * | 5/1967 | Meyer et al. | A47C 31/105 5/499 |
| 3,584,323 | A * | 6/1971 | Worley | A47G 9/086 5/413 R |
| 3,912,138 | A | 10/1975 | Pava | |
| 3,988,791 | A * | 11/1976 | Simon | A47G 9/086 5/413 R |
| 4,329,747 | A * | 5/1982 | Russell | A47G 9/062 5/924 |
| 4,513,461 | A * | 4/1985 | Tardivel | A47G 9/086 5/413 R |
| 4,757,832 | A * | 7/1988 | Russell | A45F 4/02 5/413 R |
| 5,109,559 | A * | 5/1992 | West | A47C 27/085 5/691 |
| 5,125,547 | A * | 6/1992 | Russell | A47G 9/086 224/259 |
| 5,193,235 | A | 3/1993 | Kircher | |
| 5,533,216 | A | 7/1996 | Thier | |
| 6,032,308 | A | 3/2000 | Chuang | |
| 6,637,054 | B2 * | 10/2003 | Chuang | A47G 9/0261 5/482 |
| 6,675,414 | B2 | 1/2004 | Lamke | |
| 7,051,387 | B1 | 5/2006 | Yoder et al. | |
| 7,071,707 | B2 | 7/2006 | Tiemeijer | |
| 7,171,707 | B2 * | 2/2007 | Landay | A47G 9/086 5/413 R |
| 7,263,731 | B1 | 9/2007 | Stepanek et al. | |
| 7,418,748 | B2 | 9/2008 | Lamke | |
| 8,499,381 | B1 * | 8/2013 | Miller | A47G 9/086 5/413 R |
| 10,555,628 | B2 * | 2/2020 | Szekeresh | A47G 9/08 |
| 11,395,554 | B2 * | 7/2022 | Wolffis | A47G 9/086 |
| 2001/0044236 | A1 | 11/2001 | Nobe | |
| 2003/0135924 | A1 * | 7/2003 | Chuang | A47G 9/0261 5/413 R |
| 2006/0260046 | A1 * | 11/2006 | Landay | A47G 9/086 5/413 R |
| 2012/0297539 | A1 | 11/2012 | Like et al. | |
| 2018/0168373 | A1 | 6/2018 | Szekeresh et al. | |
| 2022/0110463 | A1 * | 4/2022 | Wolffis | A47G 9/086 |
| 2022/0273120 | A1 * | 9/2022 | Born | A47G 9/064 |
| 2022/0338649 | A1 * | 10/2022 | Wolffis | A47G 9/086 |

FOREIGN PATENT DOCUMENTS

| | | | |
|---|---|---|---|
| DE | 10201612206 | A1 | 5/2018 |
| GB | 1014217 | A4 | 12/1965 |
| GB | 2384702 | A | 8/2003 |
| GB | 2453156 | A | 4/2009 |
| GB | 2744104 | B | 11/2011 |

OTHER PUBLICATIONS

Kelty, Tru Comfort-kids:, Jul. 11, 2007,https://web.archive.org/web/20170711101401/https://kelty.com/tru-comfort-kids-35/.

Seat to Summit, "Modular Approach to Sleep System" blog, Sep. 18, 2020, https://seatosummitusa.com/blogs/ask-baz/modular-approach-to-a-sleep-system.

Seat to Summit, "Modular Packing in Your Backpack" blog, Sep. 19, 2020, https://seatosummitusa.com/blogs/featured/modular-packing-in-your-backpack.

* cited by examiner

MODULAR PORTABLE BEDDING SYSTEM

REFERENCE TO RELATED APPLICATION

This application claims priority to U.S. Provisional Patent Application Ser. No. 63/200,297 filed Feb. 28, 2021, the disclosure of which is incorporated herein in its entirety.

BACKGROUND

For years, sleeping bags have been used for temporary sleeping needs, whether inside or outside. Sleeping bags have been a primary sleeping device for camping. Sleeping bags, however, have significant drawbacks. If placed directly on the ground, the ground can be hard and cold, which makes it hard to sleep. This results in an unpleasant, and less than desirable, sleeping experience. Sleeping bags typically have one zipper that zips substantially around the entire sleeping bag quilt to close the halves. This configuration creates essentially a cocoon that a user sleeps in. This arrangement restricts a user's movement in the sleeping bag while trying to sleep and makes it cumbersome to easily get in and out of the sleeping bag. Furthermore, sleeping bags are typically designed with one insulation value or insulation range. As a result, one sleeping bag is not adequately designed to handle varying weather conditions and temperatures. For instance, a low insulation value sleeping bag would not be appropriate for winter camping and, vice versa, a high insulation value bag would make summer camping very unpleasant. Also, because of size, most people do not wash their sleeping bags or blankets.

Ideally, when camping, or during any temporary sleeping activity, people want to emulate their home sleeping experience as much as possible. Because of the drawbacks of using sleeping bags alone, people have found alternatives to sleeping bags. One such approach is the use of bedding systems. With bedding systems, people combine different sleeping components, depending on their preferences and needs, to make a portable bedding system. For example, if a camper is going winter camping, he might bring a sleeping pad or mattress; a high insulation sleeping bag; a sleeping bag liner and an additional quilt. If he is going summer camping instead, he might just bring a sleeping pad or mattress and a low insulation sleeping bag.

While these custom bedding configurations do a better job of addressing needs of a specific user, they still have several drawbacks. They typically comprise custom, separate components (e.g., a separate mattress, a separate sleeping bag; a separate liner; a separate quilt). Since they are separate components, they are not connected when sleeping. As a result, these separate components tend to separate from one another as a user moves around while sleeping. This separation of the components can cause a user to get cold during sleeping, as the sleeping bag is knocked off the mattress or a quilt is kicked off. Also, because these components are separate, they typically are not easily transportable because the components are bulky and are not ideal for rolling up with each other. These types of bedding systems have limited portability because they are often hard to carry.

There have been attempts to create bedding systems that do have some of the separate components connected to one another to make them more portable, but even these attempted systems typically leave key bedding system components out, such as the mattress. With these systems, the mattress is still external to the combined bedding system components. So even though some of the bedding system components are connected and more portable than traditional, custom bedding systems, a mattress still needs to be carried separately, limiting the effectiveness of such a system.

Accordingly, there is a need for a modular portable bedding system that emulates the home sleeping experience as much as practical, where users can easily remove or change different components to customize the system to optimize the sleeping experience for the environment they plan on using it in, while still allowing the user to easily transport the customized bedding system.

SUMMARY

According to one aspect of the present invention, a portable, modular bedding system base shell may include a head portion, a foot portion, a front portion and a back portion; where the front portion includes a flexible bottom layer having a plurality of sleeping pad straps and at least one bedding component connector and where the bedding component connector is positioned at the foot portion of the bottom layer, and a flexible sidewall having a bottom edge and a top edge, where the sidewall is connected to the bottom layer along the bottom edge of the sidewall.

According to another aspect of the present invention, the base shell may have a pair of bedding component connectors and a mattress pad may be inserted into the plurality of sleeping pad straps, a fitted sheet may be secured over the mattress pad and a covering sheet and at least one quilt may be engaged with and secured by the pair of bedding component connectors According to a further aspect of the invention, the base shell may further have a portion of a fastener along the top edge of the sidewall. The base shell may also have a plurality of connection straps, and at least one attachment, wherein the plurality of connection straps attach the at least one attachment to the base shell. The base shell may further include a top layer, where the sidewall has a first zipper overlap portion along the top edge, and the top layer has a second zipper overlap portion along an edge of the top layer; where the first zipper overlap portion has a plurality of zipper teeth and tape segments that overlap one another and that each have a respective zipper slider and puller assembly and a retainer box, the second zipper overlap portion has a plurality of zipper teeth and tape segments that overlap one another and that each terminate with a retaining pin, where the retaining pins of the second zipper overlap portion can be inserted into the corresponding zipper slide and puller assemblies and retainer boxes of the first overlap portion to adjustably fasten the sidewall to the top layer. According to a further aspect of the invention, the top layer may include a foot portion and a plurality of movement seams sewn into the foot portion of the top layer, where the plurality of movement seams allow for user movement while sleeping. The top layer may be a standard size or a larger size, and the top layer may be water repellant.

DRAWINGS

Objects, features, and advantages of the present invention will become apparent upon reading the following description in conjunction with the drawing figures, in which.

Figure 4A:
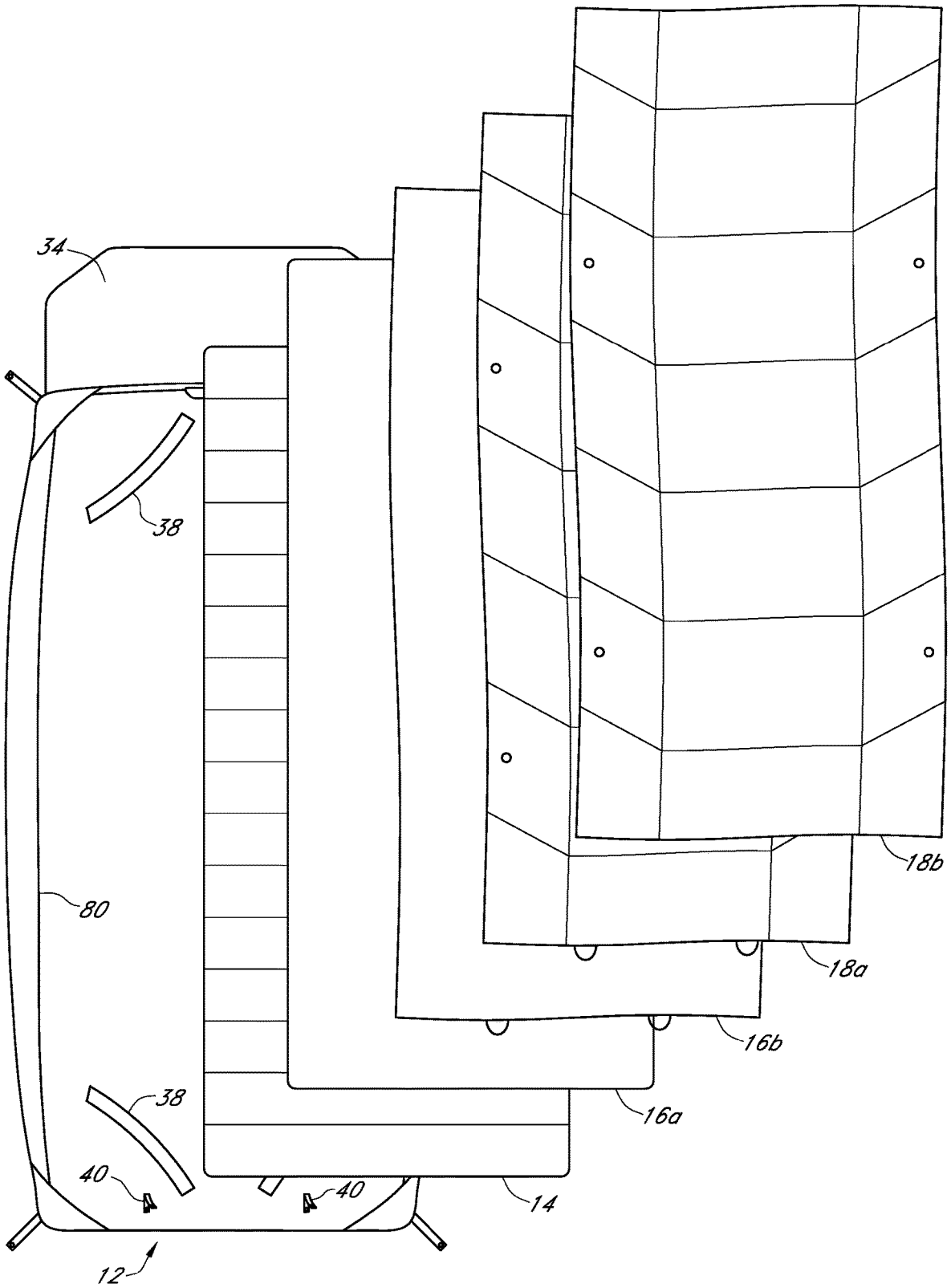
FIG. 4A depicts assembly of an embodiment of a bedding system of the present invention.
Figure 4B:
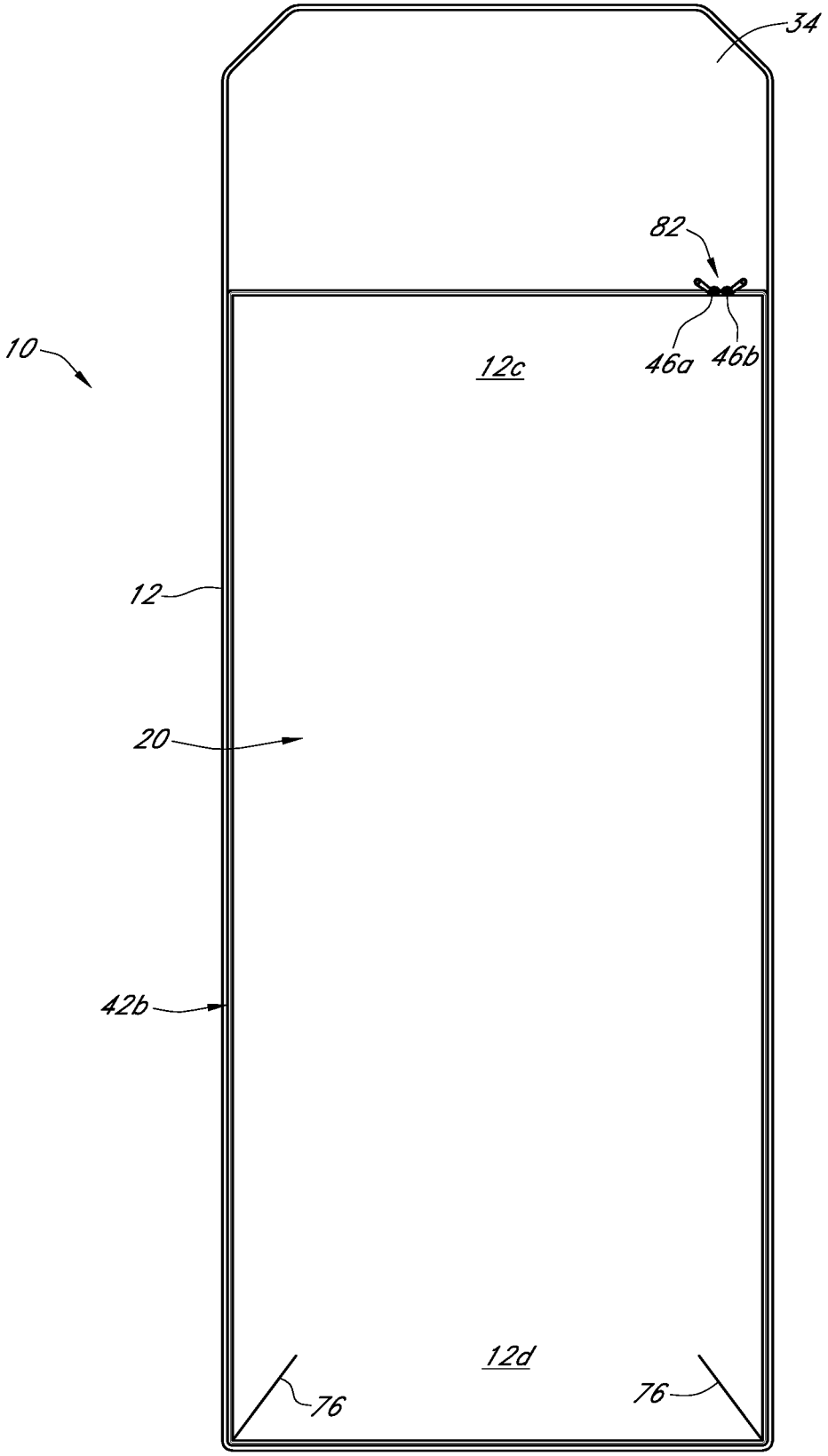
Figure 5A:
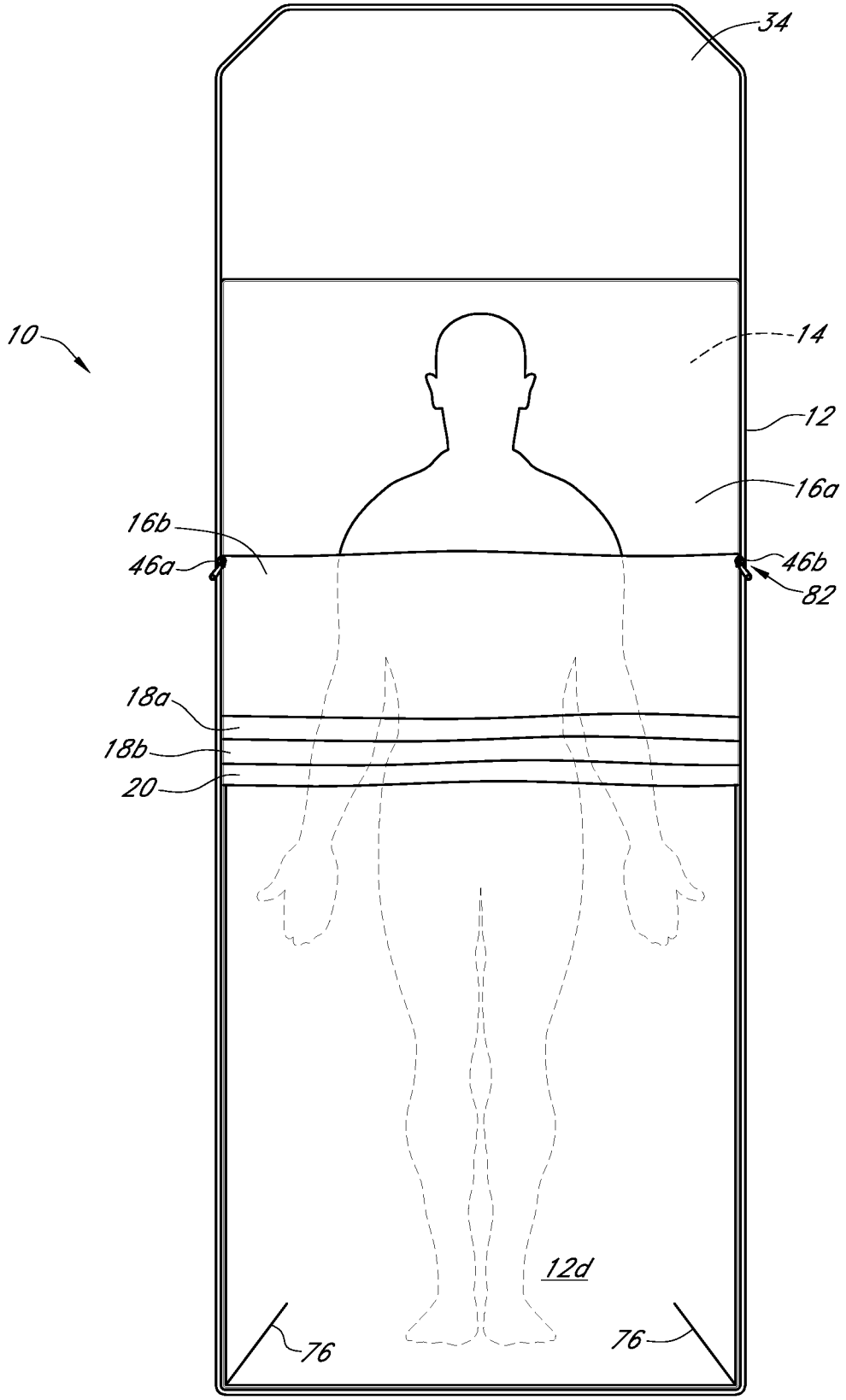
Figure 5B:
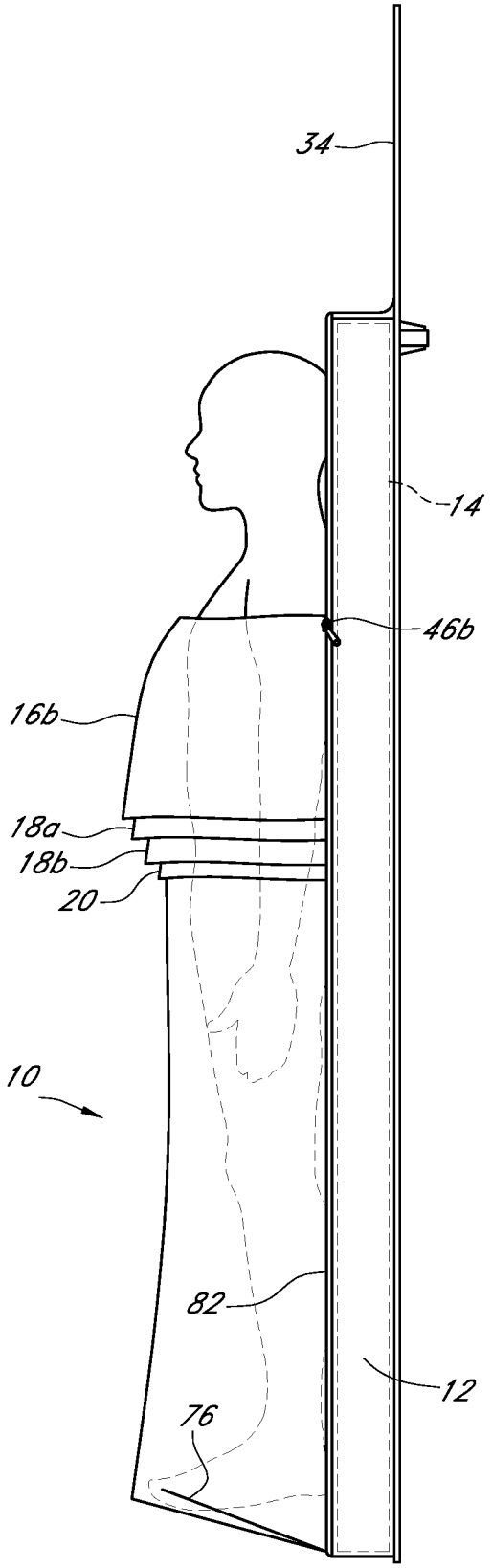
Figure 6:
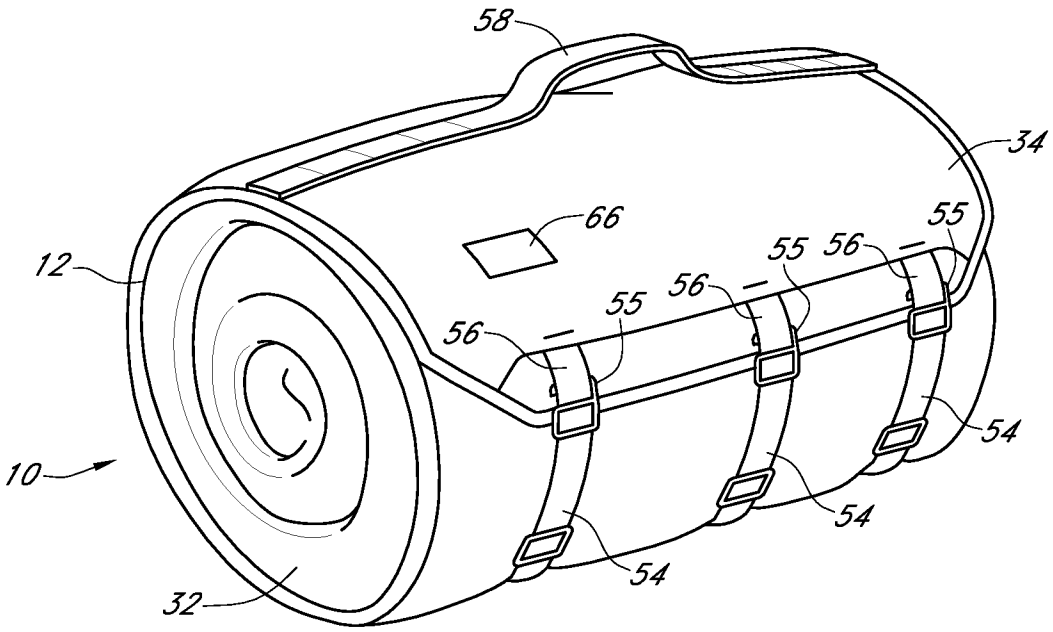
Figure 7A:
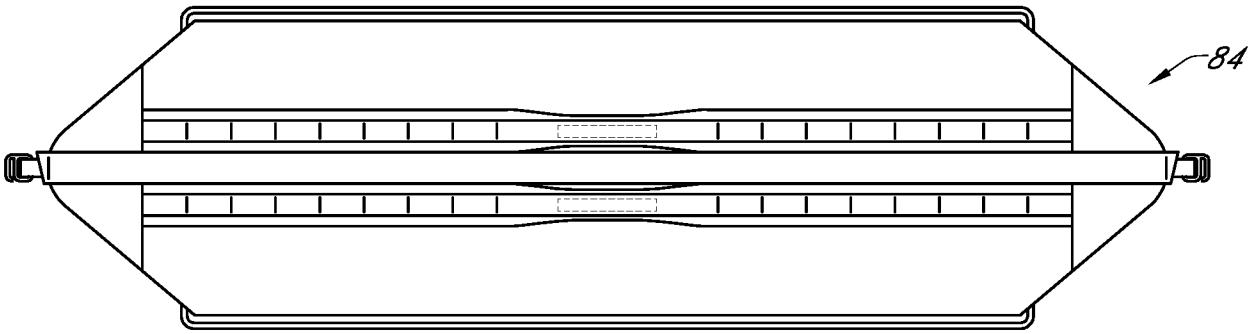
Figure 7B:
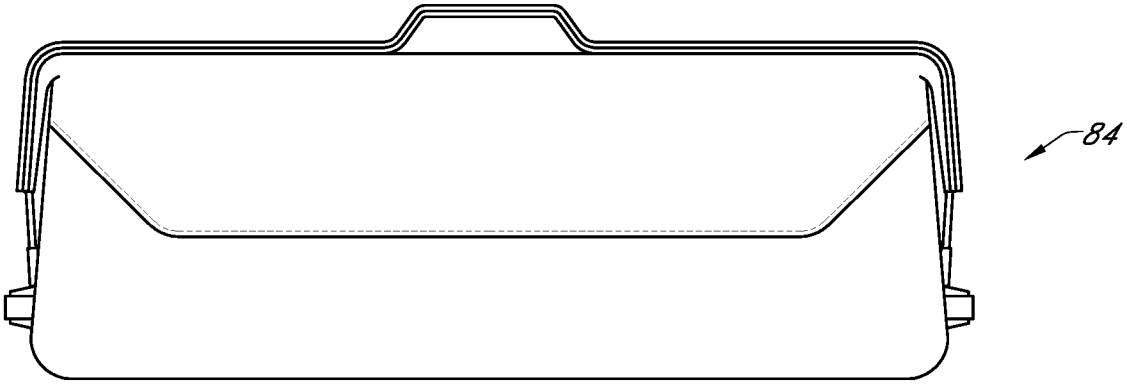
Figure 8:
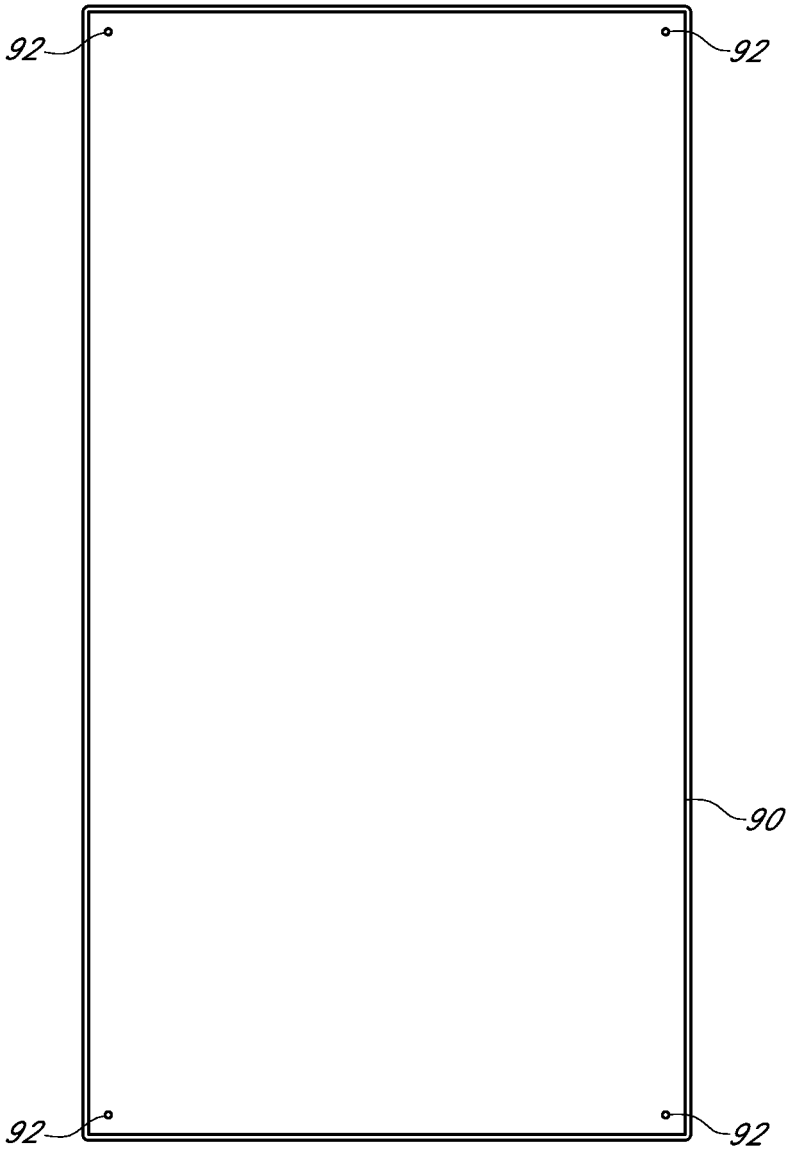
Figure 9A:
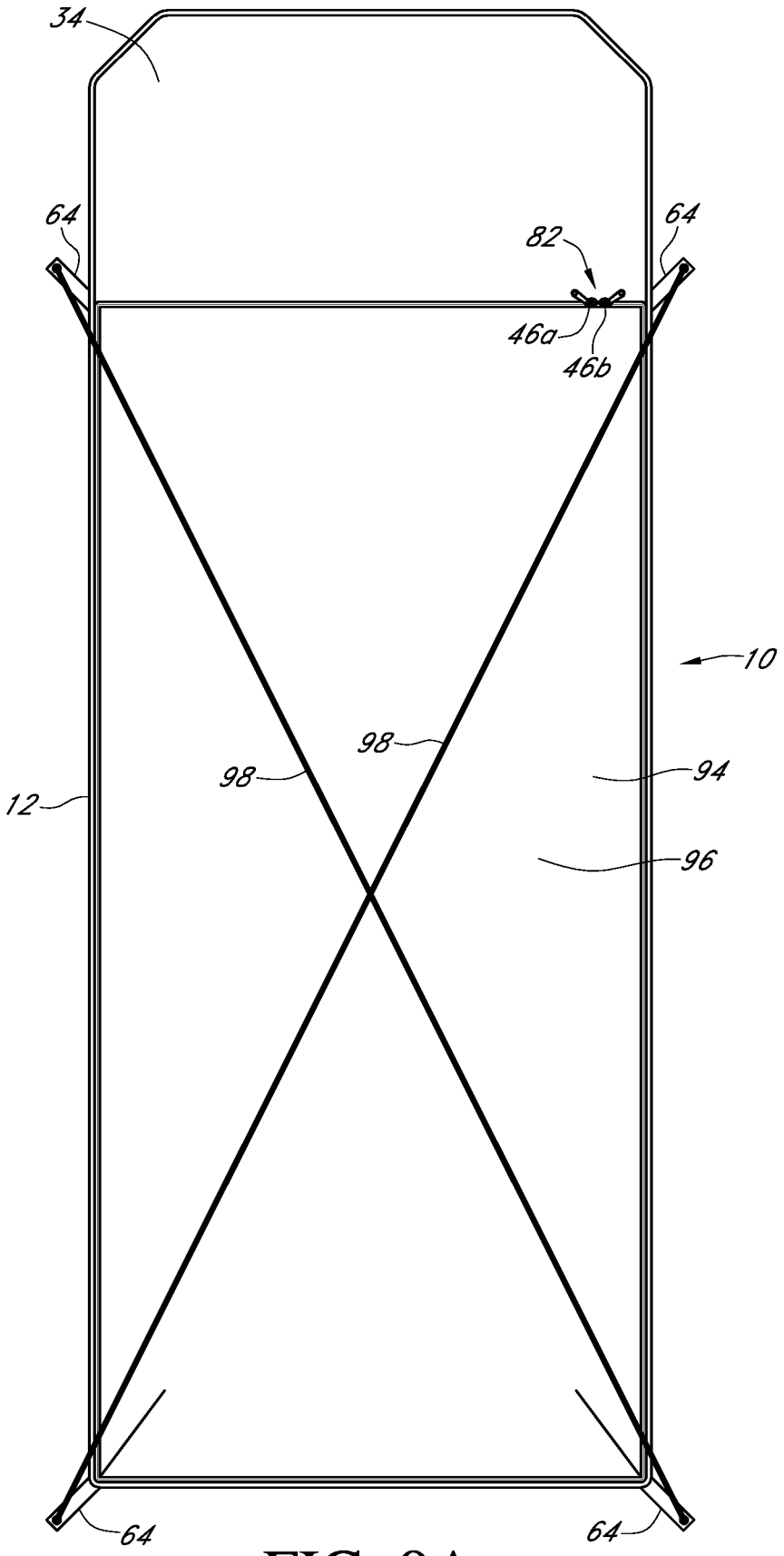
Figure 9B:
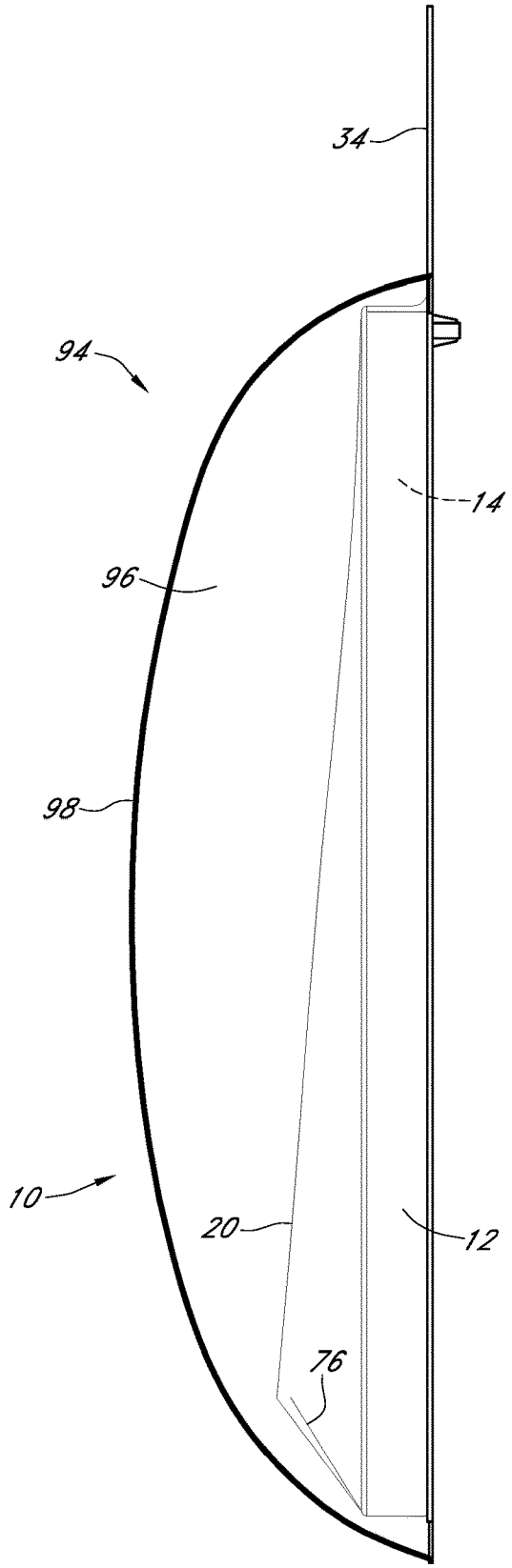

FIG. 4B a plan view of a front of an embodiment of a bedding system of the present invention with a top layer in place;

FIG. 5A is a plan view of a user in an assembly of an embodiment of the bedding system of the present invention;

FIG. 5B is a side view of a user in an assembly of an embodiment of the bedding system of the present invention;

FIG. 6 is a perspective view of an embodiment of the bedding system of the present invention rolled up and secured for transport;

FIG. 7A is a plan view of a duffel bag for storing the bedding system of the present invention;

FIG. 7B is a side view of a duffel bag for storing the bedding system of the present invention;

FIG. 8 is a plan view of a ground mat for use with the bedding system of the present invention;

FIG. 9A is a plan view of an embodiment of the bedding system of the present invention with a tent attachment; and FIG. 9B is a side view of an embodiment of the bedding system of the present invention with a tent attachment.

DESCRIPTION

Figure 1A:
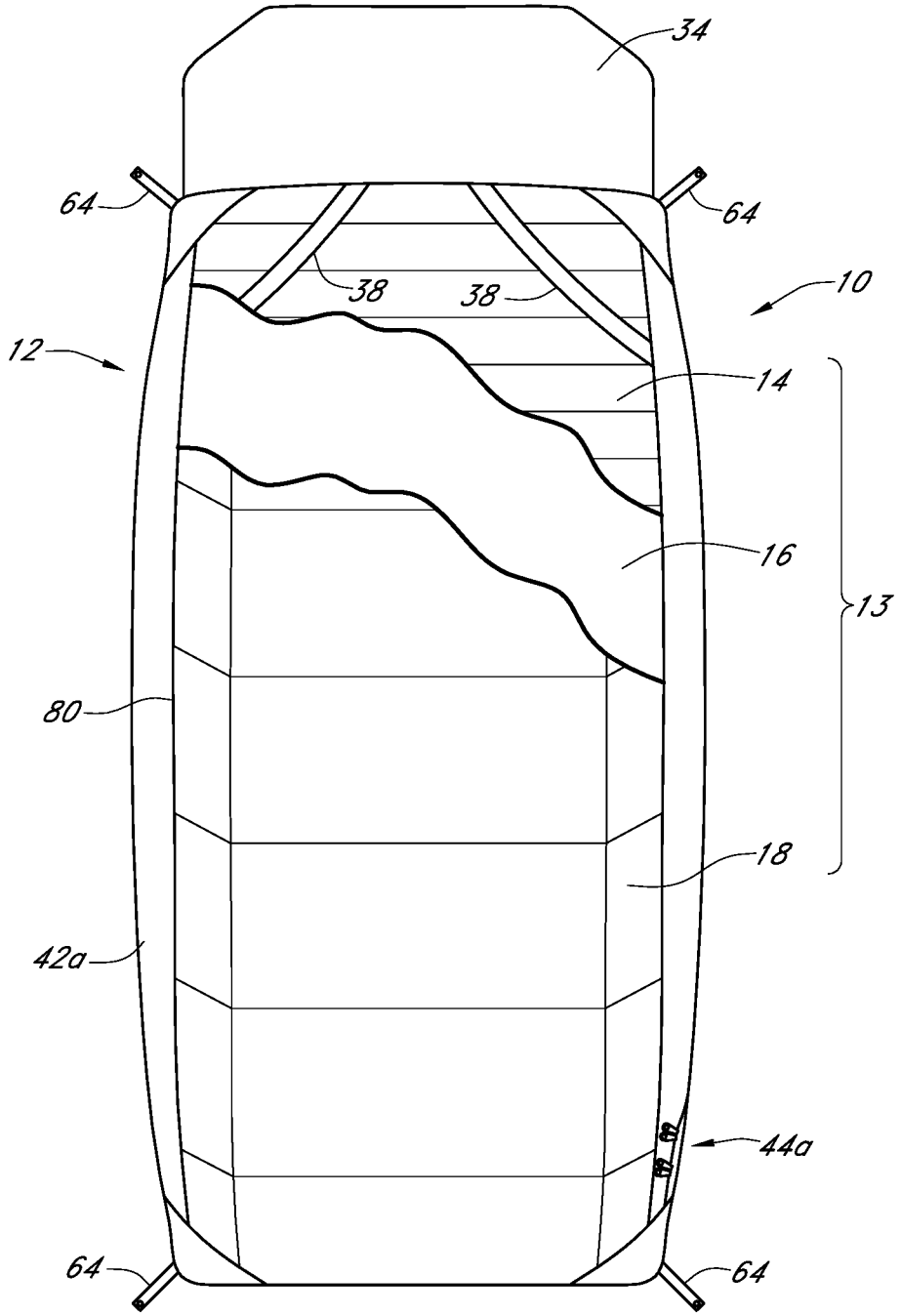
FIG. 1A is a plan view of a front of an embodiment of a bedding system of the present invention, illustrating cutaways of the differing bedding components of this embodiment.
Figure 1B:
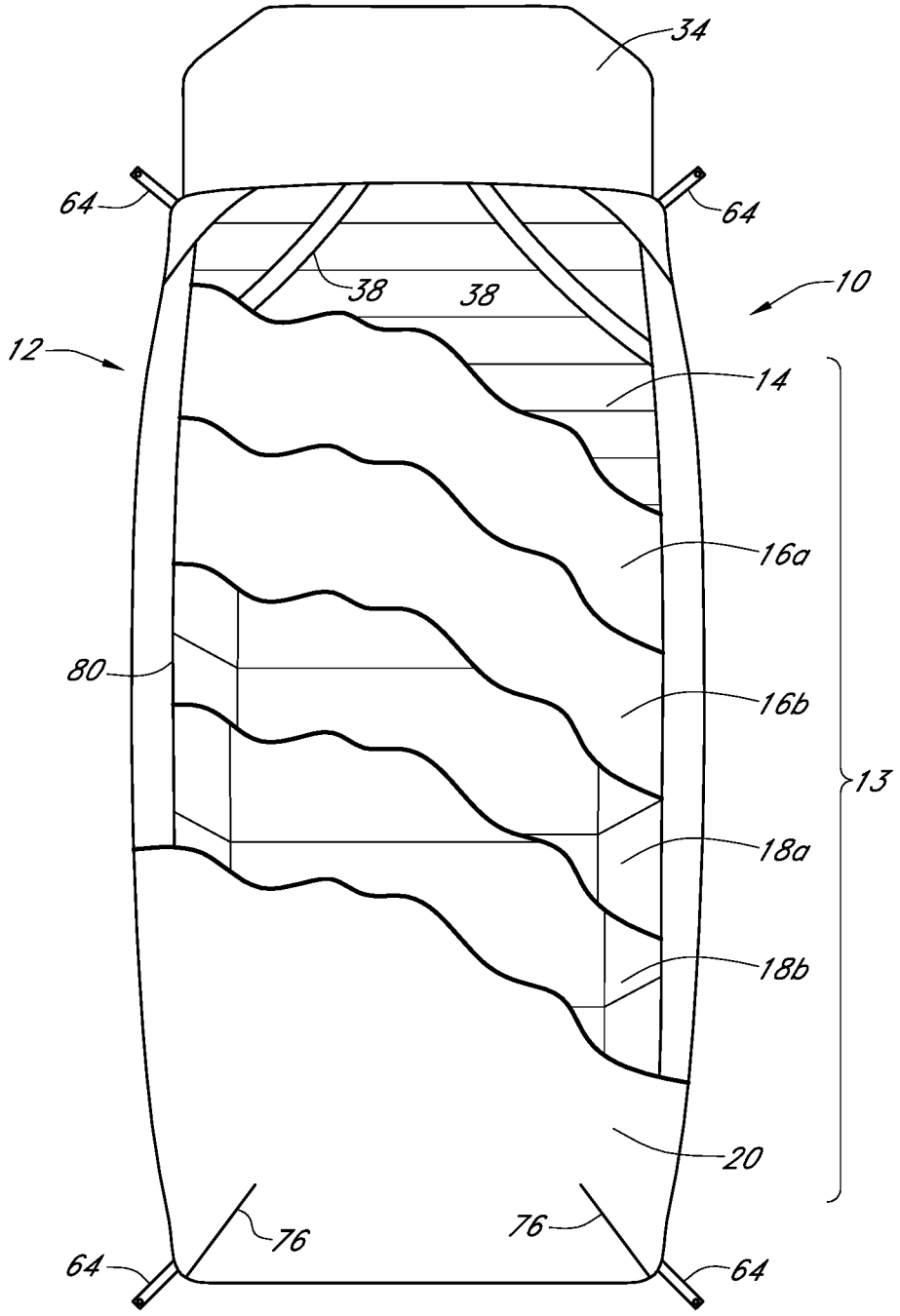
FIG. 1B is a plan view of a front of a further embodiment of a bedding system of the present invention, illustrating cutaways of the differing bedding components of this embodiment.

Referring to FIG. 1A, an embodiment of a bedding system 10 of the present invention illustrates four main components exposed by cutaways: 1) a base shell 12 and a selection of bedding components 13: 2) a sleeping pad 14, 3) a sheet layer 16 and 4) an insulation layer 18. Referring to FIG. 1B, a more specific embodiment of a bedding system 10 of the present invention includes the base shell 12 and the following bedding components 13 exposed by cutaways: the sleeping pad 14, a fitted sheet 16*a* and a cover sheet 16*b* in the sheet layer 16, a down quilt 18*a* and a synthetic quilt 18*b* in the insulation layer 18 and a top layer 20. As explained in detail below, not all of the bedding components 13 of the bedding system 10 described above are required in every embodiment of the invention. The user can mix and match the bedding components 13 to customize the bedding system 10 to the user's needs. By being able to separate all of the bedding components 13 from each other, this makes maintenance and cleaning of the bedding system 10 more convenient than in the past. A user of the bedding system 10 of the present invention can wash each bedding component 13 separately, if desired, and not have to deal with washing one large bulky item like a sleeping bag. Also, if one of the quilts 18*a*, 18*b* or any other bedding component 13 is ripped, otherwise damaged or worn out from use, the entire bedding system 10 does not become unusable. Rather, the user can fairly easily replace the damaged bedding component 13 and continue to use the bedding system 10.

Figure 2A:
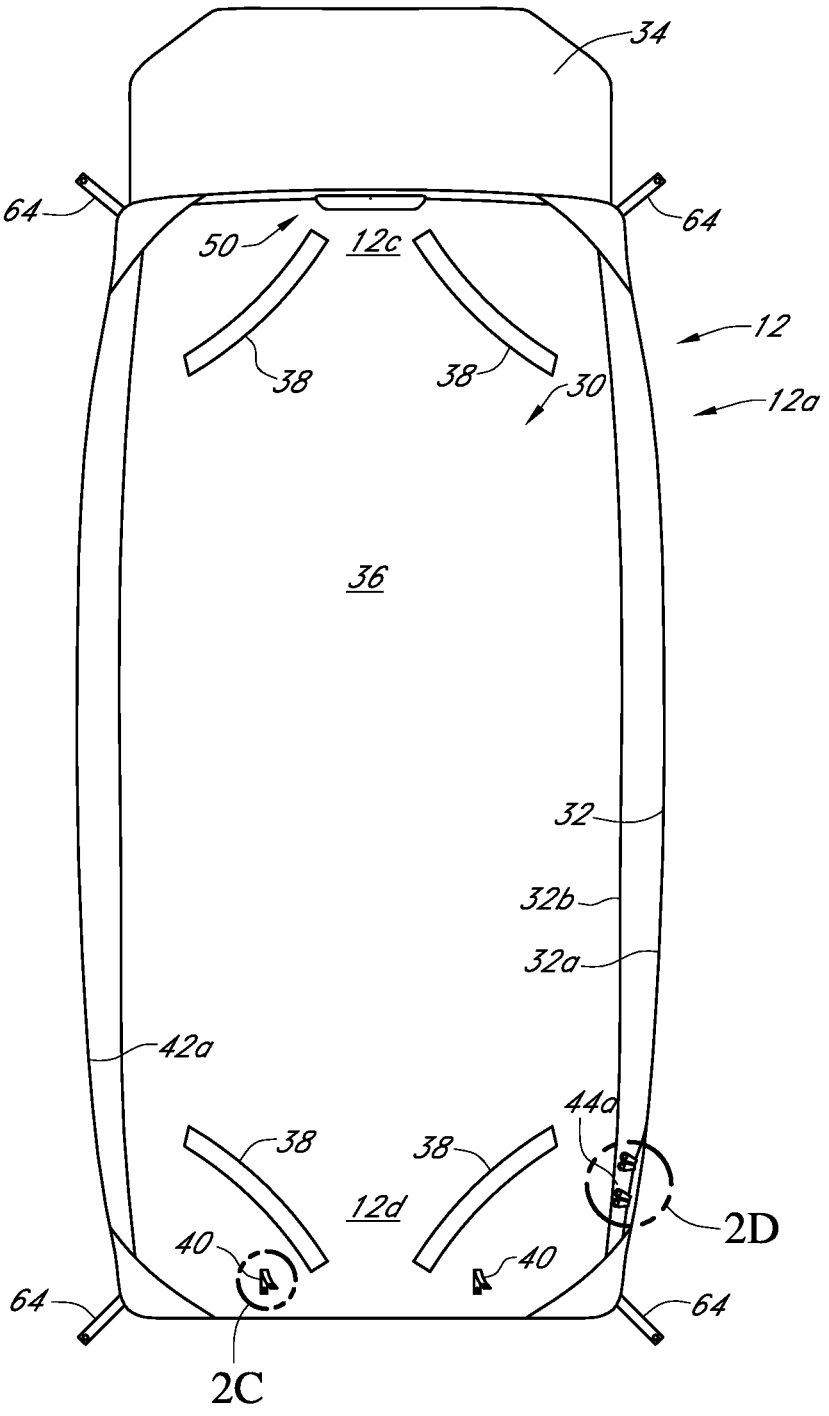
FIG. 2A is a plan view of an embodiment of a front of a base shell of the present invention.
Figure 2B:
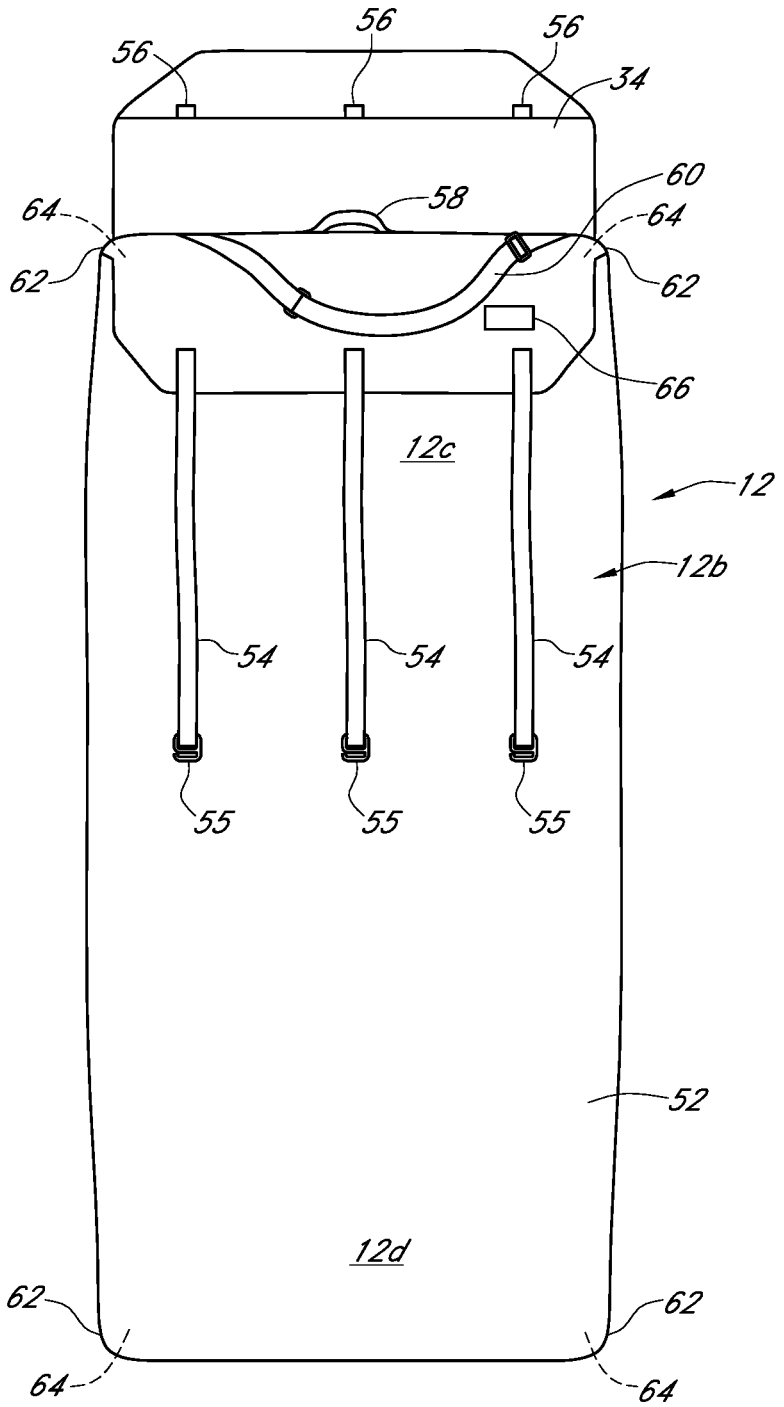
FIG. 2B is a plan view of an embodiment of a back of a base shell of the present invention.

Referring to FIGS. 2A, 2B, the base shell 12 of the bedding system 10 has a front 12*a* (FIG. 2A), a back 12*b* (FIG. 2B), head portion 12*c* and a foot portion 12*d*. Referring to FIG. 2A, the front 12*a* of the base shell 12 has a bottom layer 30, a sidewall 32 and a flap 34. In a preferred embodiment, the bottom layer 30, the sidewall 32 and the flap 34 are made of a durable flexible, heavy fabric material that is coated with a durable water resistant coating ("DWR"), making these materials water resistant to shed moisture away from the bedding system 10 and to limit moisture from entering the inside of the bedding system 10. The heavy fabric material used for the bottom layer 30 and the sidewall 32 is strong enough to protect the bedding components 13 within the bottom layer 30 and the sidewall 32 from damage from such items as sticks, stones and other jagged ground clutter. Further, in a preferred embodiment, the sidewall 32 is a semi-rigid structure formed with padding encased within the outer heavy fabric material. In this preferred embodiment, the sidewall 32 is slightly higher than four inches. The sidewall 32 has a top edge 32*a* and a bottom edge 32*b*. The bottom edge 32*b* of the sidewall 32 connects to the bottom layer 30 around the periphery of the bottom layer 30 forming an interior space 36. The interaction between the sidewall 32 and the bottom layer 30 creates a raised bathtub design that protects the interior space 36 from sand, dirt, moisture or other impediments. In a preferred embodiment, the connection between the sidewall 32 and the bottom layer 30 is a reinforced, sewn connection.

Figure 2C:
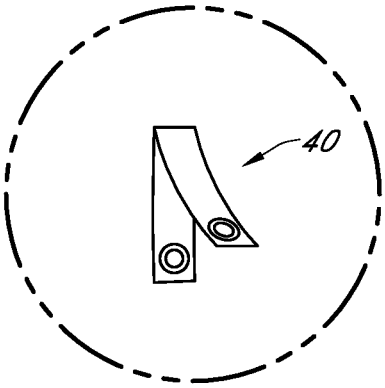
FIG. 2C is a detailed view of a bedding component connector depicted in FIG. 2A.

In the interior space 36, in this embodiment, four sleeping pad straps 38 are attached to the bottom layer 30. Two are attached near the head portion 12*c* of the bottom layer 30, and two are attached near the foot portion 12*d* of the bottom layer 30. In a preferred embodiment, the sleeping pad straps 38 are elastic and have a side coated with rubber that prevents the sleeping pad 14 from sliding when the straps 38 engage the sleeping pad 14. In this embodiment, two bedding component connectors 40 (FIG. 2C) are also attached to the bottom layer 30 and are attached near the foot portion 12*d*. In a preferred embodiment, the bedding component connectors 40 are straps with snaps that snap together. One of skill in the art would understand that the sleeping pad straps 38 and the bedding component connectors 40 are not limited to the amount recited above for this embodiment and that any amount needed could be used to practice this invention and that these bedding system components are not limited to the structures and materials disclosed herein.

Figure 2D:
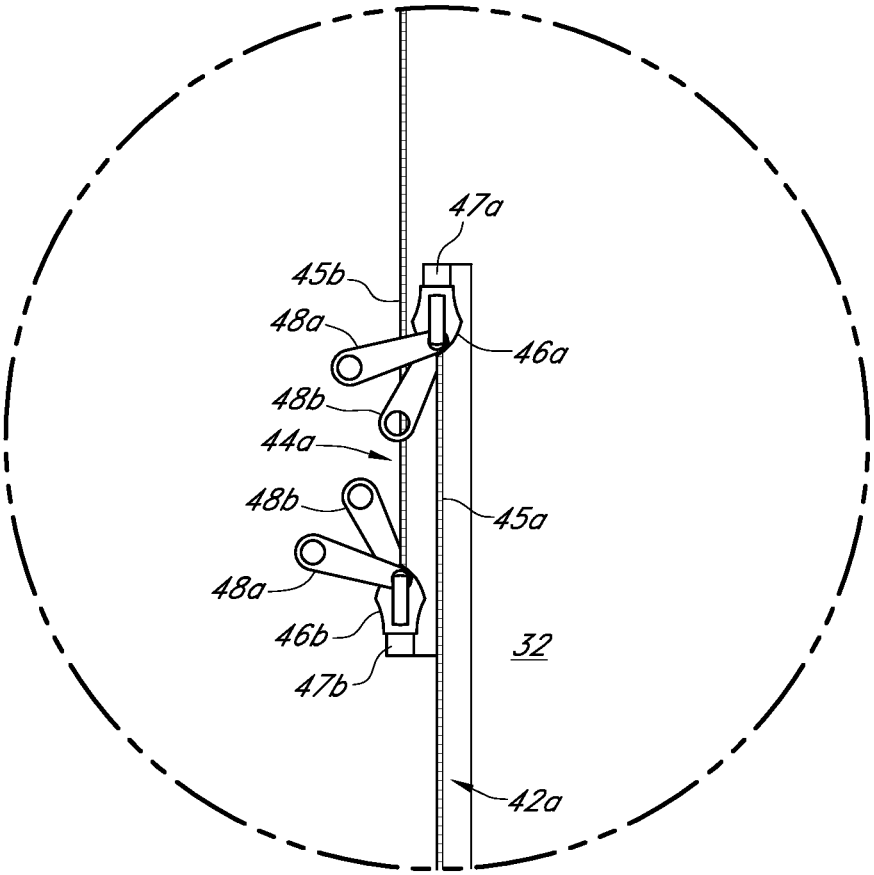
FIG. 2D is a detailed view of a fastener portion connected to a top edge of a sidewall depicted in FIG. 2A.

In this embodiment of the present invention, the top edge 32*a* of the sidewall 32 has a fastener portion 42*a* that extends around the entire top edge 32*a* of the sidewall 32. In a preferred embodiment, the fastener portion 42*a* is a zipper portion and, as depicted in FIGS. 2A and 2D, the zipper portion 42*a* has a section that overlays itself near the foot portion 12*d* of the sidewall 32. The overlay 44*a* consists of two portions of zipper teeth and tape segments 45*a*, 45*b* that overlay one another. The overlay 44*a* is significant, as discussed below, because it allows each side of a complete zipper assembly 82 (FIGS. 2G and 5A) along the periphery of the sidewall 32 to be zipped closed or zipped open independently of each other. Without the overlay portion 44*a*, the user would have to open or close the zipper assembly 82 along the entire periphery of the sidewall 32. In a preferred embodiment, the zipper portion 42*a* also has a pair of sliders 46*a*, 46*b* with slider 46*a* attached to zipper teeth and tape segment 45*a* constrained by a retainer box 47*a*, and slider 46*b* attached to zipper teeth and tape segment 45*b* constrained by a retainer box 47*b*. Each slider 46*a*, 46*b* has a pair of pullers 48*a*, 48*b*. One puller 48*a* on each slider 46*a*, 46*b* faces outward to the environment outside the base shell 12, and the other puller 48*b* on each slider 46*a*, 46*b* faces inward toward the interior space 36 of the base shell 12. As explained in more detail below, the outside pullers 48*a* allow a user to operate the zipper assembly 82 (FIG. 2G) from the outside, and the inside pullers 48*b* allow a user to operate the zipper assembly 82 from inside the bedding system 10.

Figure 2E:
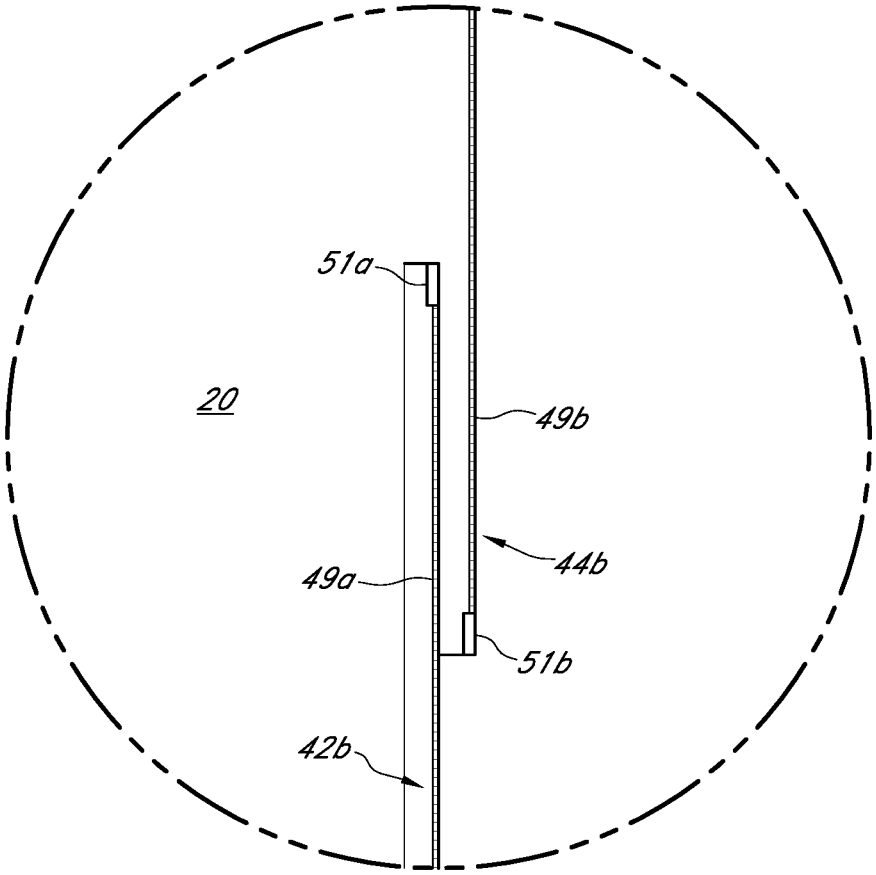
FIG. 2E is a detailed view of a fastener portion connected to a top layer of the present invention.
Figure 2F:
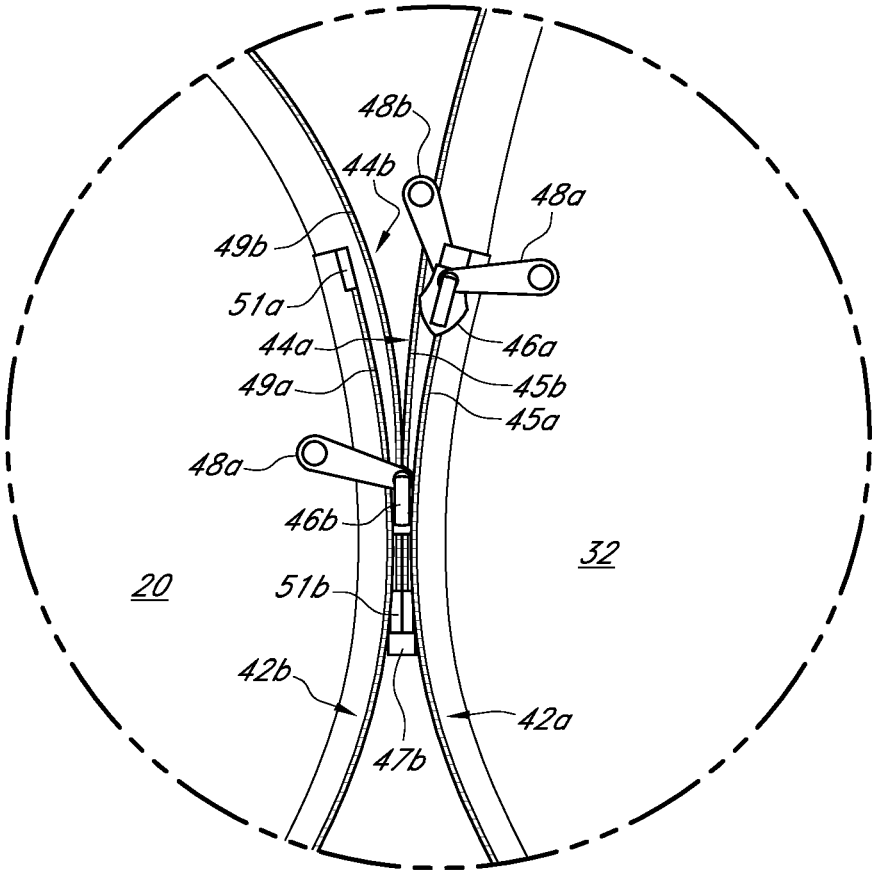
FIG. 2F is a detailed view of an embodiment of fastener portions of the present invention being connected to one another.
Figure 2G:
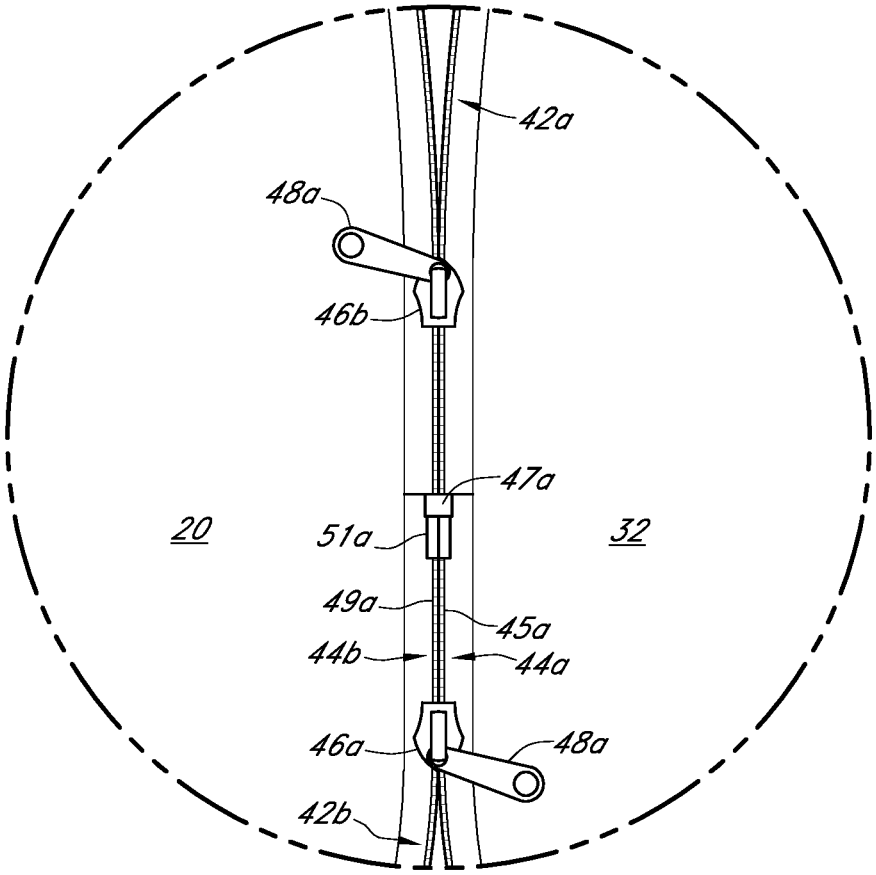
FIG. 2G is a detailed view of an embodiment of fastener portions of the present invention connected together.
Figure 2H:
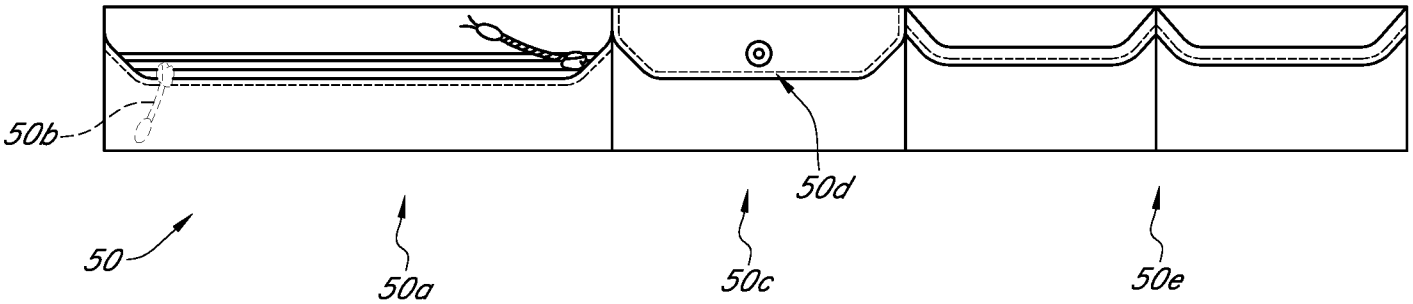
FIG. 2H is a detailed view of an embodiment of accessory pouches of the present invention.

Referring to FIGS. 2A and 2H, in this embodiment, the base shell 12 also includes a set of storage pouches 50 located near the head portion 12*c* that the user of the bedding system 10 can use for storage. In the preferred embodiment, the set of storage pouches 50 includes a first zipper pouch 50*a* with a clip 50*b* for keys or any other clippable item, a second pouch 50*c* with a magnetic closure 50*d* for a cell phone and any other items and a third open pouch 50*e* for a flashlight, headlamp or any other item used by the user 82.

Referring to FIG. 2B, the back 12*b* of the base shell 12 includes a ground layer 52, the back of the flap 34, a set of adjustable closure straps 54, each having an attached hook 55, a corresponding set of closure loops 56, a carrying handle 58, a shoulder strap 60, which is removeable, and a hook and loop area 66, where a user can attach a removeable patch, such as patch identifying the user of the bedding system 10. In a preferred embodiment, the ground layer 52, similar to the bottom layer 30 and the sidewall 32 described above, is made of a flexible, durable heavy fabric material, coated with DWR. In this embodiment, the ground layer 52 includes garages 62, which are cutouts that house rolled up connection straps 64.

Figure 3A:
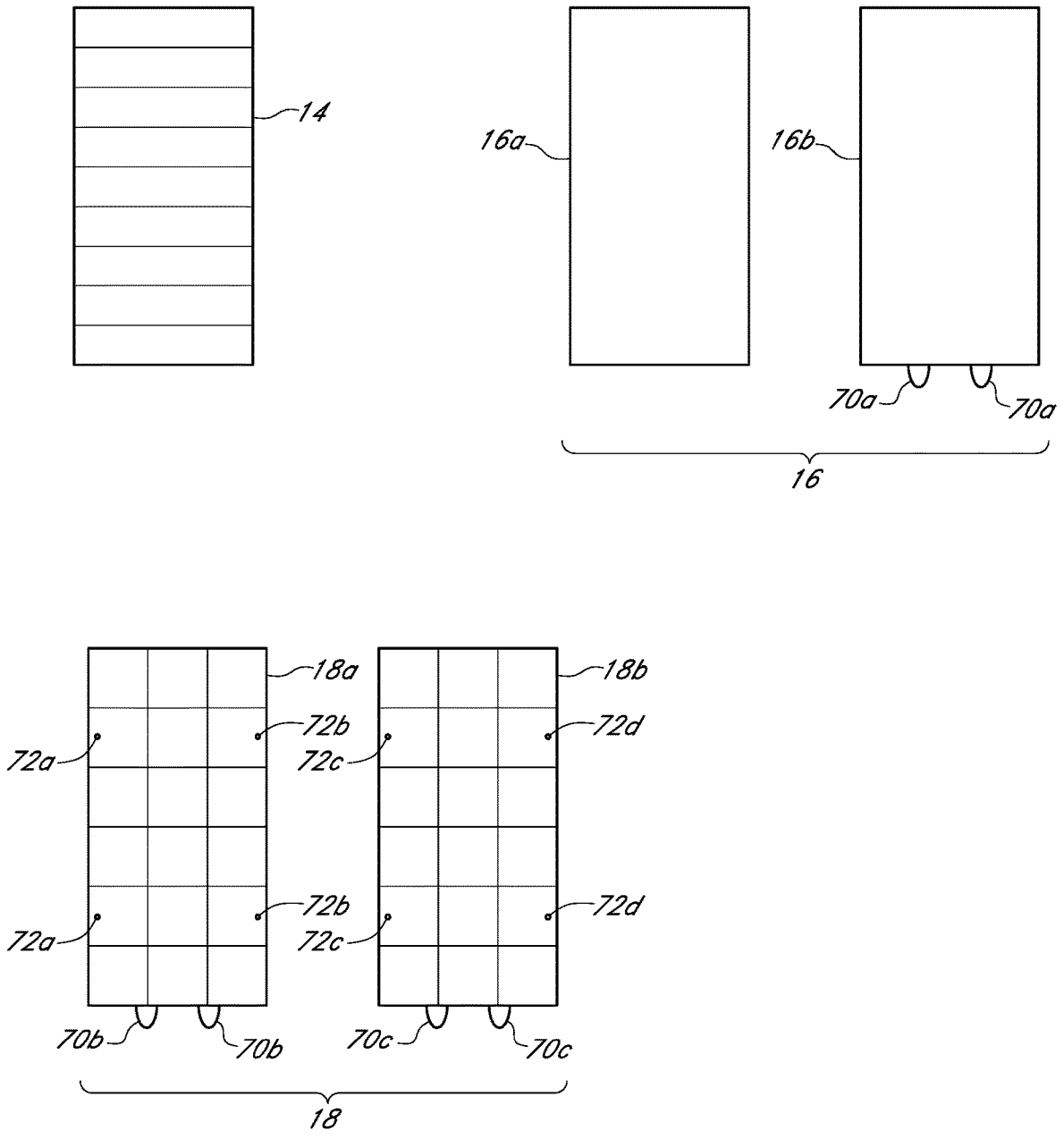
FIG. 3A depicts different bedding components for use in an embodiment of the present invention.
Figure 3B:
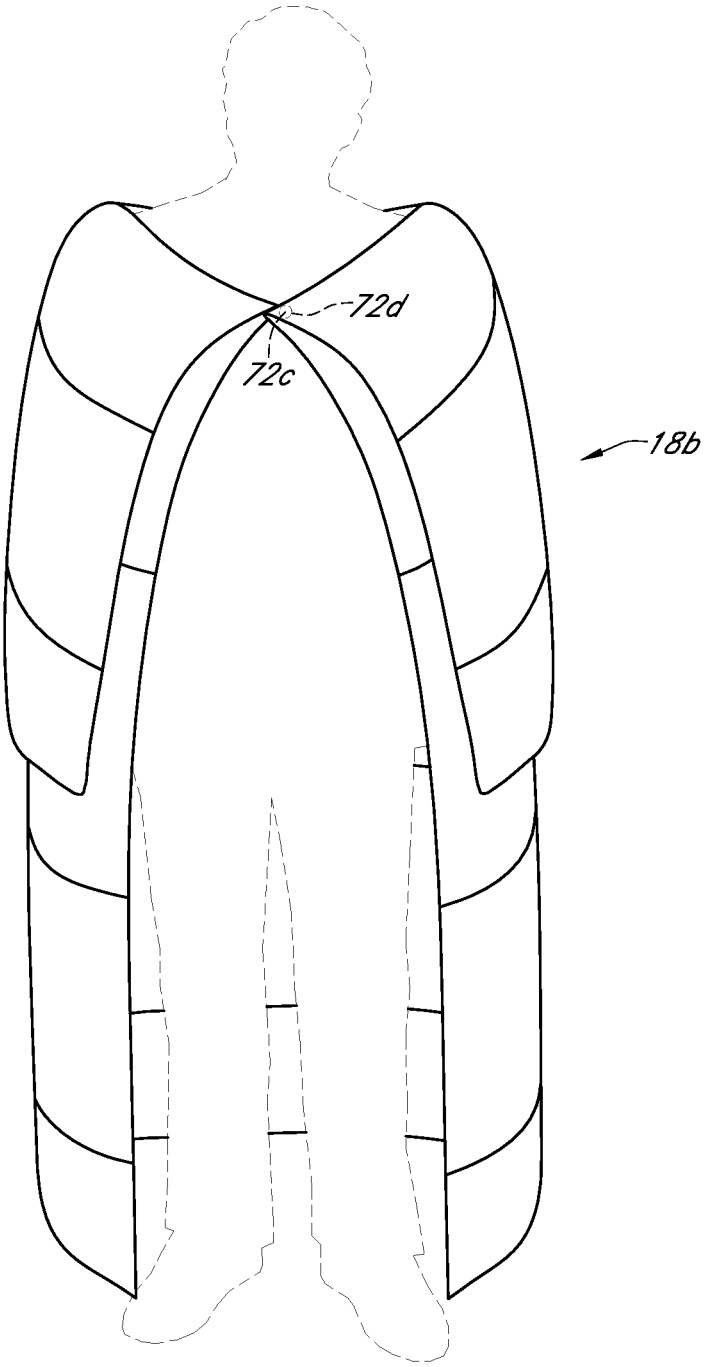
FIG. 3B depicts the use of an embodiment of a quilt of the present invention.

Referring to FIGS. 1A, 1B, 3A, 4A and 4B, different bedding components 13 that a user may use in the bedding system 10 of the present invention are depicted. The sleeping pad 14 may be a foam mattress or pad, an inflatable air mattress or any other device or pad that a user may use to elevate himself from the ground. In a preferred embodiment, the sleeping pad 14 is an inflatable mattress that is approximately four inches thick. The sheet layer 16 may include a fitted sheet 16*a* and a cover sheet 16*b*. The fitted sheet 16*a* is a known fitted sheet arrangement with elastic around the edges to hold it in place when placed on the sleeping pad 14. The cover sheet 16*b* includes connection loops 70*a*. The sheets 16*a*, 16*b* may be made from any materials known in the art, such as flannel, cotton or silk. The insulation layer 18 may include a down quilt 18*a* and a synthetic quilt 18*b*. The quilts 18*a*, 18*b* are not limited to down or synthetic materials. They be made from any insulation material known in the art, including wool, cotton or any blended insulation materials, including a mix of down and synthetic materials. In a preferred embodiment, the quilts 18*a*, 18*b* are made from a rugged nylon-type material. The down quilt 18*a* and the synthetic quilt 18*b* each include connection loops 70*b*, 70*c*, respectively. The down quilt 18*a* and the synthetic quilt 18*b* also each include a set of snaps 72*a*, 72*b* and 72*c*, 72*d*, respectively. The snaps 72*a*, 72*b* of down quilt 18*a* are designed to snap into the snaps 72*c*, 72*d* of synthetic quilt 18*b*. In a preferred embodiment, each quilt 18*a*, 18*b* has two snaps on each side with alternating male and female snaps. The snaps are alternated in this fashion so snaps opposite to each other on the quilt can snap into each other. This snap configuration provides several advantages to the bedding system user, including that the user can opt to sleep between the quilts 18*a*, 18*b*, in order to have quilt insulation on the top and bottom of his body, without the quilts 18*a*, 18*b* separating with respect to one another while sleeping. This snap configuration also allows the user of the quilts 18*a*, 18*b* to make either one or both into cape or cloak for added warmth while walking around the camp site (FIG. 3B).

Figure 3C:
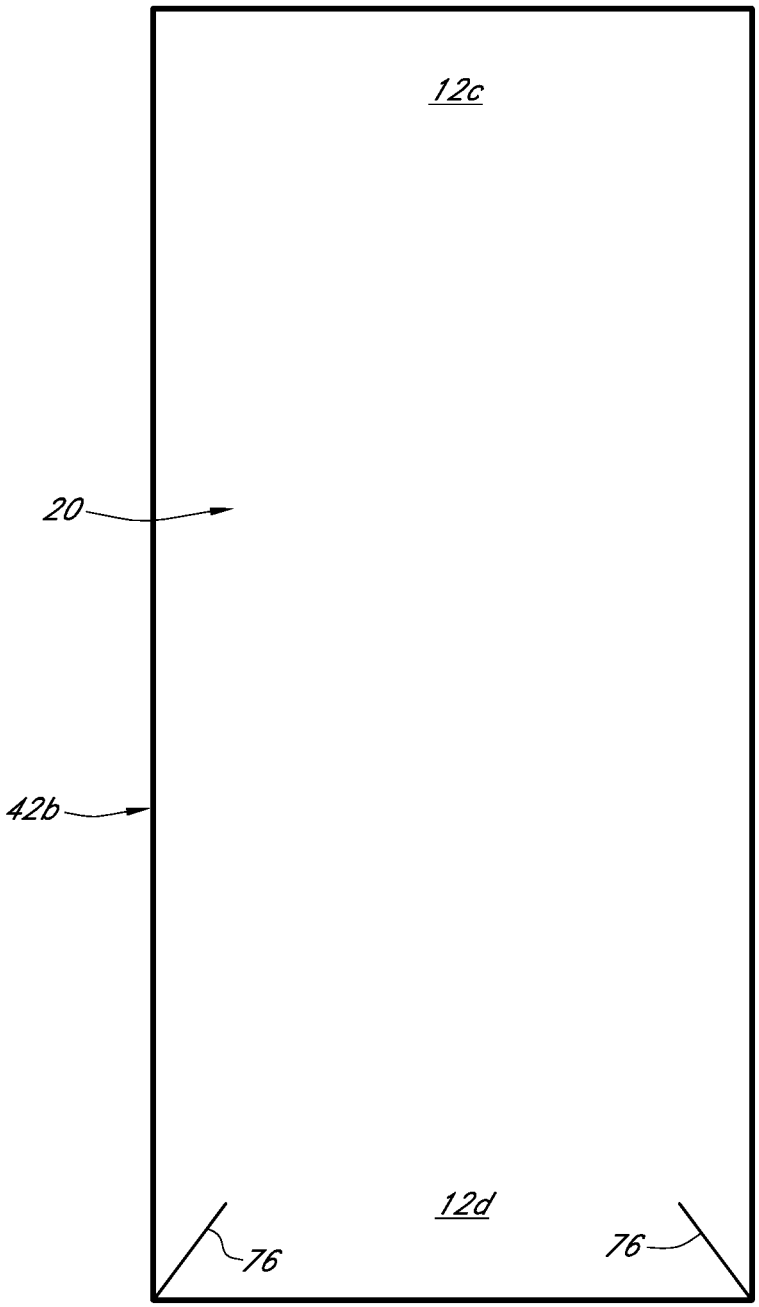
FIG. 3C is a plan view of a front of an embodiment of a top layer of the present invention.

Referring to FIGS. 1B, 2E and 3C, the top layer 20 of an embodiment of the present invention has a fastener portion 42*b* that extends around the entire edge of the top layer 20. In a preferred embodiment, the fastener portion 42*b* is a zipper portion and, as depicted in FIG. 2E, the zipper portion 42*b* has a section that overlays itself. The overlay 44*b* consists of two portions of zipper teeth and tape segments 49*a*, 49*b* that overlay one another and that each terminate with a retaining pin 51*a*, 51*b*. The top layer 20 also includes movement seams 76 (FIG. 3C). The movement seams 76 are created at the corners of the top layer 20 at the foot portion 12*d* of the top layer 20. The movement seams 76 allow extra material to be added to the foot portion 12*d* of the top layer 20, which allows the user to have more room for movement while using the bedding system 10. The movement seams 76 can be made of different lengths and configurations. This allows the top layer 20 to come in different sizes, which allows the user to choose a top layer 20 based upon how much room for movement the user wants to have in the bedding system 10. In addition, in a preferred embodiment, the top layer 20 is made from a two-way stretch material that aids in limiting movement restriction when a user sleeps in the bedding system 10. Also, in a preferred embodiment, the top layer 20 is coated with DWR to allow for beading and shedding of light moisture from the elements or condensation to protect the bedding components 13 of the bedding system 10.

Referring to FIGS. 1B and 4A, when a user is ready to use the bedding system 10 of the present invention, he determines, based on the weather, comfort level or any other factors, which bedding components 13 of the bedding system 10 he wants to use. In this embodiment, he is using all of the bedding components 13 depicted in FIG. 4A. In this example, the user is using an air mattress as the sleeping pad 14. The user first inflates the air mattress 14. The user then inserts the air mattress 14 into the interior space 36 of the base shell 12 and connects the air mattress 14 to the base shell 12 by inserting the air mattress 14 into the four sleeping pad straps 38. The inserted air mattress 14 and the sidewall 32 create a gutter 80 in the interior space 36 on both sides of the air mattress 14. The user then puts the fitted sheet 16*a* onto the air mattress 14, using the elastic around the edges to engage the air mattress 14. Next, the user places the cover sheet 16*b* on top of the air mattress/fitted sheet combination 14, 16*a*. The cover sheet 16*b* may be oversized in width to provide adequate coverage of the user. The user fastens the cover sheet 16*b* in place by inserting the bedding component connectors 40 through the connection loops 70*a*.

Next, the user snaps the snaps 72*a*, 72*b* of the down quilt 18*a* to the corresponding snaps 72*c*, 72*d* of the synthetic quilt 18*b* to secure the two quilts 18*a*, 18*b* to each other so they do not move with respect to each other while in use. The user then places the quilt combination 18*a*, 18*b* on top of the cover sheet 16*b*. The user fastens the quilt combination 18*a*, 18*b* in place by inserting the bedding component connectors 40 through the connection loops 70*b*, 70*c*. The user snaps bedding component connectors 40 closed to secure the cover sheet 16*b*, the down quilt 18*a* and the synthetic quilt 18*b* at the foot portion 12*d* of the base shell 12. The user, at this point, can also tuck the sides of the cover sheet 16*b*, the down quilt 18*a* and the synthetic quilt 18*b* into the gutter 80. This secures the sides of the cover sheet 16*b* and the quilt combination 18*a*, 18*b* and helps keep the user warmer by restricting side air flow under the cover sheet 16*b* and the quilt combination 18*a*, 18*b* which often occurs in modular sleeping systems where the covers and quilts are not secured in place. The extra material of the sides of the cover sheet 16*b* and the quilt combination 18*a*, 18*b* tucked into the gutter 80 allow a side sleeper more room for movement while sleeping without losing the side protection of the cover sheet 16*b* and the quilt combination 18*a*, 18*b*.

Referring to FIGS. 1B, 2D-G and 4B, with the air mattress 14, the sheet layer 16 and the insulation layer 18 in place in the interior space 36, the user attaches the top layer 20. The user attaches top layer 20 to the base shell 12 by connecting the fastener portion 42*b* of the top layer 20 to the fastener portion 42*a* of the base shell 12. Referring specifically to FIG. 2F, in a preferred embodiment, the user first inserts the retaining pin 51*b* of zipper teeth and tape segment 49*b* into slider 46*b* and then pulls on puller 48*a* of slider 46*b* to engage the teeth of zipper teeth and tape segment 49*b* with the counterpart teeth of zipper teeth and tape segment 45*b* of the base shell 12. The user then inserts retaining pin 51*a* of zipper teeth and tape segment 49*a* into slider 46*a* and then pulls on puller 48*a* of slider 46*a* to engage the teeth of zipper teeth and tape segment 49*a* with the counterpart teeth of zipper teeth and tape segment 45*a* of the base shell 12. As depicted in FIG. 2G, the top layer 20 is now connected to the base shell 12 by the engagement of the zipper teeth and tape segments 45*a*, 45*b*, 49*a*, 49*b* at the overlay portions 44*a*, 44*b*. With the engagement of the zipper teeth and tape segments 45*a*, 45*b*, 49*a*, 49*b*, the complete zipper assembly 82 is formed (FIG. 4B), and the user can now independently zip up either side of the bedding system 10 by pulling on any of the pullers 48*a*, 48*b* of the sliders 46*a*, 46*b*. The user can use the zipper assembly 82 to completely enclose the interior space 36, as depicted in FIG. 4B. With the top layer 20 covering the entire interior space 36, a user can use the bedding system 10 as a place to sit or for other purposes, such as a place for his dog to sleep. In another embodiment, a tent or screen attachment (not depicted) is attached to the base shell 12 using the zipper assembly 82, in a similar manner as the top layer 20 is attached as described above, to provide the user a protective tent structure over the base shell 12.

Referring to FIGS. 5A and 5B, a preferred embodiment, using the base shell 12, the air mattress 14, the fitted sheet 16*a*, the cover sheet 16*b*, the down quilt 18*a*, the synthetic quilt 18*b* and the top layer 20, of the bedding system 10 of the present invention is shown in use. As referenced above, the user does not have to use every bedding component 13 of the bedding system 10 when configuring the bedding system 10 for use. In the use depicted, the user steps onto the flap 34 and remove his shoes before entering the base shell 12. With his shoes removed, the user slides into the bedding system 10 and lies in the space between the fitted sheet 16*a* and the cover sheet 16*b*, the down quilt 18*a*, the synthetic quilt 18*b* and the top layer 20. After adjusting himself in the defined space, the user zips the zipper assembly 82 up along three-quarters of each side of the sidewall 32. In this depiction, as seen in FIG. 5B, the movement seams 76 near the foot portion 12*d* of the bedding system 10 allow the user more room for his feet, which allows him more room for movement during sleeping to keep him from feeling constrained.

When the user is finished sleeping and ready to move the bedding system 10, the user does not need to remove the air mattress 14, the fitted sheet 16*a*, the cover sheet 16*b*, the down quilt 18*a*, the synthetic quilt 18*b* or the top layer 20 from the base shell 12. In the preferred embodiment, the user partially lifts the fitted sheet 16*a* to expose an air release valve (not depicted) on the air mattress 14. In the preferred embodiment, once the air is released from the air mattress 14, the user tightly rolls the bedding system 10 up from the foot portion 12*d* to the head portion 12*c* along the front 12*a* of the base shell 12. Once tight, the user inserts the hooks 55 of each closure strap 54 into each corresponding closure loop 56. The user then adjusts the closure straps 54 to tighten the bedding system 10 into a carriable roll (FIG. 6). In this configuration, the flap 34 serves the protective purpose of protecting the interior contents of the bedding system 10. Also, in this configuration, the user can easily carry the bedding system 10 in several ways, including by using the carrying handle 58 or the should strap 60, if connected. In another embodiment, as depicted in FIGS. 7A and 7B, the user can insert the rolled up bedding system 10 into a duffel bag 84 for added protection from the elements during transport.

In varying embodiments, the bedding system 10 can be used with additional accessories and attachments. Referring to FIGS. 8, 9*a* and 9B, the connection straps 64 of the bedding system 10 can be used to attach accessories that add additional functionality to the bedding system 10. For instance, FIG. 8 depicts a ground mat 90 having grommets 92. In a preferred embodiment, the ground mat 90 is made from the same material as the bottom layer 30 of the base shell 12 and is wider than the base shell 12, giving the user additional protected ground space to place personal, or other, items on. In use, the ground mat 90 is put on the ground, and the connection straps 64 are then removed from their respective garages 62, unfurled and connected with the grommets 92 of the ground mat 90. The ground mat 90 gives the user an extra layer of separation from the ground and further protects the back 16*b* of the base shell 12 from anything on the ground that might rip or damage the base shell 12. FIGS. 9A and 9B depict a tent attachment 94. The tent attachment 94 has a tent fabric 96 and tent poles 98. In use, the tent fabric 96 and the tent poles 98 are connected together, and the tent poles 98 are connected to the connection straps 64 of the bedding system 10 to form an integrated tent structure over the bedding system 10.

Although certain embodiments and features of a modular portable bedding system have been described herein, the scope of coverage of this patent is not limited thereto. On the contrary, this patent covers all embodiments of the teachings of the disclosure that fairly fall within the scope of permissible equivalents.

What is claimed is:

1. A portable, modular bedding system base shell, comprising:

a head portion, a foot portion, a front portion and a back portion; wherein the front portion includes:

a flexible bottom layer having a plurality of sleeping pad straps and at least one bedding component connector, wherein the bedding component connector is positioned at the foot portion of the bottom layer; and a flexible sidewall having a bottom edge and a top edge, wherein the sidewall is connected to the bottom layer along the bottom edge of the sidewall and wherein the at least one bedding component connector is positioned within the periphery of the sidewall.

2. The base shell of claim 1, wherein the at least one bedding component connector is a pair of bedding component connectors.

3. The base shell of claim 2, wherein a mattress pad is inserted into the plurality of sleeping pad straps, a fitted sheet is secured over the mattress pad and a covering sheet and at least one quilt are engaged with and secured by the pair of bedding component connectors.

4. The base shell of claim 1, further comprising a portion of a fastener along the top edge of the sidewall.

5. The base shell of claim 1, further comprising:

a plurality of connection straps, and at least one attachment, wherein the plurality of connection straps attach the at least one attachment to the base shell.

6. The base shell of claim 1, further comprising a top layer.

7. The base shell of claim 6, wherein:

the sidewall has a first zipper overlap portion along the top edge; and the top layer has a second zipper overlap portion along an edge of the top layer; wherein:

the first zipper overlap portion has a plurality of zipper teeth and tape segments that overlap one another and that each have a respective zipper slider and puller assembly and a retainer box;

the second zipper overlap portion has a plurality of zipper teeth and tape segments that overlap one another and that each terminate with a retaining pin; wherein the retaining pins of the second zipper overlap portion can be inserted into the corresponding zipper slider and puller assemblies and retainer boxes of the first overlap portion to adjustably fasten the sidewall to the top layer.

8. The base shell of claim 6, wherein the top layer includes a foot portion and a plurality of movement seams sewn into the foot portion of the top layer, wherein the plurality of movement seams allow for user movement while sleeping.

9. The base shell of claim 8, wherein the top layer is a standard size.

10. The base shell of claim 8, wherein the top layer is a larger size.

11. The base shell of claim 7, wherein the top layer is water repellant.

12. The base shell of claim 1, wherein the back portion of the base shell includes:

a plurality of closure straps, each having a hook; and a plurality of closure loops, wherein when the base shell is rolled up the closure hooks can be inserted into the closure loops to keep the base shell closed during transport.

13. A zipper fastener system, comprising:

a first material having a first zipper overlap portion along an edge of the first material; and a second material having a second zipper overlap portion along an edge of the second material; wherein:

the first zipper overlap portion has a plurality of zipper teeth and tape segments that overlap one another and that each have a respective zipper slider and puller assembly and a retainer box;

the second zipper overlap portion has a plurality of zipper teeth and tape segments that overlap one another and that each terminate with a retaining pin; wherein the retaining pins of the second zipper overlap portion can be inserted into the corresponding zipper slider and puller assemblies and retainer boxes of the first overlap portion to adjustably fasten the first material to the second material.

14. A portable, modular bedding system, comprising:

a base shell having a head portion, a foot portion, a front portion and a back portion; wherein the front portion includes:

a flexible bottom layer having a plurality of sleeping pad straps and at least one bedding component connector, wherein the bedding component connector is positioned at the foot portion of the bottom layer; and a flexible sidewall having a bottom edge and a top edge, wherein the sidewall is connected to the bottom layer along the bottom edge of the sidewall and wherein the at least one bedding component connector is positioned within the periphery of the sidewall;

a sleeping pad;

a sheet layer; and an insulation layer.

15. The bedding system of claim 14, wherein:

the sleeping pad is a mattress pad and the mattress pad is inserted into the plurality of sleeping pad straps;

the sheet layer includes a fitted sheet and a covering sheet, wherein the fitted sheet is secured over mattress pad and the covering sheet is engaged with and secured by the at least one bedding component connector; and the insulation layer includes at least one down quilt and at least one synthetic quilt, wherein the down quilt and the synthetic quilt are engaged with and secured by the at least one bedding component connector.

16. The bedding system of claim 14, further comprising a top layer.

17. The bedding system of claim 16, wherein:

the sidewall has a first zipper overlap portion along the top edge; and the top layer has a second zipper overlap portion along an edge of the top layer; wherein:

the first zipper overlap portion has a plurality of zipper teeth and tape segments that overlap one another and that each have a respective zipper slider and puller assembly and a retainer box;

the second zipper overlap portion has a plurality of zipper teeth and tape segments that overlap one another and that each terminate with a retaining pin; wherein the retaining pins of the second zipper overlap portion can be inserted into the corresponding zipper slider and puller assemblies and retainer boxes of the first overlap portion to adjustably fasten the sidewall to the top layer.

18. The bedding system of claim 16, wherein the base shell and the top layer are water repellant.

19. The bedding system of claim 14, wherein the back portion of the base shell includes:

a plurality of closure straps, each having a hook; and a plurality of closure loops, wherein when the base shell is rolled up the closure hooks can be inserted into the closure loops to keep the bedding system closed during transport.

20. The bedding system of claim 19, further comprising:

a duffel bag, wherein the rolled up bedding system can be carried in the duffel bag.

* * * * *